US009603441B2

(12) United States Patent
Waguespack et al.

(10) Patent No.: US 9,603,441 B2
(45) Date of Patent: Mar. 28, 2017

(54) TOOTHBRUSH

(71) Applicant: Colgate-Palmolive Company, New York, NY (US)

(72) Inventors: Kenneth Waguespack, North Brunswick, NJ (US); Robert Moskovich, East Brunswick, NJ (US); Tanja Langgner, London (GB); Joachim Storz, Zell am See (AT); Thomas Kuchler, Zell am See (AT)

(73) Assignee: COLGATE-PALMOLIVE COMPANY, New York, NY (US)

( * ) Notice: Subject to any disclaimer, the term of this patent is extended or adjusted under 35 U.S.C. 154(b) by 26 days.

(21) Appl. No.: 14/627,068

(22) Filed: Feb. 20, 2015

(65) Prior Publication Data

US 2015/0157120 A1 Jun. 11, 2015

Related U.S. Application Data

(63) Continuation of application No. 13/647,005, filed on Oct. 8, 2012, now Pat. No. 8,990,996, which is a (Continued)

(51) Int. Cl.

*A46B 9/04* (2006.01)
*A46B 5/02* (2006.01)

(Continued)

(52) U.S. Cl.

CPC ..... *A46B 9/04* (2013.01); *A46B 5/0029* (2013.01); *A46B 5/02* (2013.01); *A46B 5/021* (2013.01); *A46B 5/026* (2013.01); *A46B 7/06* (2013.01); *A46B 9/025* (2013.01); *A46B 9/026* (2013.01); *A46B 9/028* (2013.01); *A46B 15/0081* (2013.01); *A46B 2200/1066* (2013.01)

(58) Field of Classification Search

CPC .... A46B 5/00; A46B 5/02; A46B 9/04; A46B 9/026; A46B 5/026

USPC ..... 15/167.1, 172, 110

See application file for complete search history.

(56) References Cited

U.S. PATENT DOCUMENTS 52,833 A * 2/1866 Eagle ..... A46B 7/06 15/201
301,644 A 7/1884 Thompson (Continued)

FOREIGN PATENT DOCUMENTS

CA 2004029 5/1990
CH 99738 6/1923

(Continued)

OTHER PUBLICATIONS

Delft, 1986, "Construeren in Kunststoffen Deel B".

(Continued)

*Primary Examiner* — Michael Jennings

(57) ABSTRACT

A toothbrush that enhances cleaning and user comfort while brushing. In one embodiment, the toothbrush comprises a cleaning element support member, or base member, that permits a head of the toothbrush to be comfortably received and manipulated within the user's mouth. In an embodiment, the support member comprises a head support having an overhanging portion and a portion free of an overhang.

16 Claims, 8 Drawing Sheets

Related U.S. Application Data continuation-in-part of application No. 11/535,259, filed on Sep. 26, 2006, now Pat. No. 8,533,891, said application No. 13/647,005 is a continuation-in-part of application No. 12/576,445, filed on Oct. 9, 2009, now Pat. No. 8,393,042, which is a continuation-in-part of application No. 11/053,589, filed on Feb. 8, 2005, now Pat. No. 7,725,981, which is a continuation of application No. PCT/US03/24879, filed on Aug. 8, 2003.

(60) Provisional application No. 60/720,418, filed on Sep. 26, 2005, provisional application No. 60/402,165, filed on Aug. 9, 2002.

(51) Int. Cl.

| | |
|---|---|
| ***A46B 5/00*** | (2006.01) |
| ***A46B 9/02*** | (2006.01) |
| ***A46B 7/06*** | (2006.01) |
| *A46B 15/00* | (2006.01) |

(56) References Cited

U.S. PATENT DOCUMENTS 585,358 A 6/1897 Gould
697,336 A 4/1902 Hagerty
726,727 A 4/1903 Mills
758,764 A 5/1904 Macleod
759,490 A 5/1904 Yates
803,995 A 11/1905 Davenport
864,054 A 8/1907 Abrams
907,842 A 12/1908 Meuzies
914,501 A 3/1909 McEachem
958,371 A 5/1910 Danek
1,002,468 A 9/1911 Strangman
1,006,630 A 10/1911 Clarke
1,007,328 A 10/1911 Brandstetter
1,022,920 A 4/1912 Anderson
1,058,273 A 4/1913 Thompson
1,125,532 A 1/1915 Himmel
1,128,139 A 2/1915 Hoffman
1,132,326 A 3/1915 Fouyer
1,142,698 A 6/1915 Grove
1,153,409 A 9/1915 Wheeler
1,191,556 A 7/1916 Blake
1,251,250 A 12/1917 Libby
1,268,544 A 6/1918 Gates
1,327,757 A 1/1920 Eggers
1,327,807 A 1/1920 Burleigh
1,369,966 A 3/1921 Cosens et al.
1,405,279 A 1/1922 Cassedy
1,466,723 A 9/1923 Riichiro
1,470,710 A 10/1923 Davis
1,495,675 A 5/1924 Colt
1,588,785 A 6/1926 Van Sant
1,598,224 A 8/1926 Van Sant
1,616,484 A 2/1927 Beynon
1,620,330 A 3/1927 Douglass
1,639,880 A 8/1927 Butler
1,658,706 A 2/1928 Carrot
D75,971 S 8/1928 Fauber et al.
1,688,581 A 10/1928 Glassman
1,704,564 A 3/1929 Friedland
1,705,109 A 3/1929 Essbach
1,728,956 A 9/1929 Darmitzel
1,741,143 A 12/1929 Chin
1,770,195 A 7/1930 Burlew
1,796,001 A 3/1931 Church
1,796,641 A 3/1931 Zimmerman et al.
1,816,582 A 7/1931 Heron
1,817,585 A 8/1931 Samuel
1,833,555 A 11/1931 Bell et al.
1,860,924 A * 5/1932 Cooke ..... A46B 5/0025 15/111
1,861,347 A 5/1932 Johnson
1,872,832 A 8/1932 Siverberg
1,891,864 A 12/1932 Barrett
1,892,068 A 12/1932 Metzler
1,894,509 A 1/1933 Booth
1,903,161 A 3/1933 Babkan
1,924,152 A 8/1933 Coney et al.
1,927,365 A 9/1933 Frolio
1,928,328 A 9/1933 Carpentier
1,976,271 A 10/1934 Vachoux
1,993,662 A 3/1935 Green
1,993,763 A 3/1935 Touchstone
2,003,243 A 5/1935 Campbell et al.
2,028,011 A 1/1936 Raymond
D99,352 S 5/1936 Grapp
2,042,239 A 5/1936 Planding
2,049,956 A 8/1936 Greenberg
2,059,914 A 11/1936 Rosenberg
2,079,728 A 5/1937 Arnold
2,083,217 A 6/1937 Brothers et al.
2,097,987 A 11/1937 Phillips
2,111,880 A 3/1938 Waters
2,117,174 A 5/1938 Jones
2,129,082 A 9/1938 Byrer
2,139,245 A 12/1938 Ogden
2,148,483 A 2/1939 Love et al.
2,161,349 A 6/1939 Hadden
2,164,219 A 6/1939 McGerry
2,176,309 A 10/1939 Love et al.
2,186,005 A 1/1940 Casto
2,196,284 A 4/1940 Ackerman
2,209,173 A 7/1940 Russell
D122,815 S 10/1940 Crosby
2,218,072 A 10/1940 Runnels
2,225,331 A 12/1940 Campbell
2,233,936 A 3/1941 Campbell
2,263,885 A 5/1941 McGauley
2,244,098 A 6/1941 Busick
2,253,210 A 8/1941 Psiharis
2,253,910 A 8/1941 Luenz
2,254,365 A 9/1941 Grifith et al.
2,262,982 A 11/1941 Wolcott
2,263,802 A * 11/1941 Grusin ..... A46B 3/00 15/110
2,266,195 A 12/1941 Hallock
2,305,461 A 12/1942 Spyra
2,312,828 A 3/1943 Adamsson
2,326,632 A 8/1943 Friedman
2,364,205 A * 12/1944 Fuller ..... A61H 13/00 15/188
2,405,029 A 7/1946 Gallanty et al.
2,418,485 A 4/1947 Shipley
2,438,268 A * 3/1948 Bressler ..... A46B 5/0025 15/167.1
2,443,297 A 6/1948 Bressler
2,491,274 A 12/1949 McNeil
2,512,059 A 6/1950 Haeusser
2,543,999 A 3/1951 Voss
D162,941 S 4/1951 Ehrman
2,554,777 A 5/1951 Dangin
2,574,654 A 11/1951 Moore
2,583,750 A 1/1952 Runnels
2,631,320 A 3/1953 Bressler
2,634,722 A 4/1953 Frederick
2,637,870 A 5/1953 Cohen
2,642,604 A 6/1953 Ferrari
2,650,383 A 9/1953 Bressier
2,651,068 A 11/1953 Seko
2,676,350 A * 4/1954 Bressler ..... A46B 5/0025 15/167.1
2,685,703 A * 8/1954 Dellenbach ..... A46B 5/0025 15/167.1
2,686,325 A 8/1954 Silver
2,702,914 A 3/1955 Kittle et al.
2,706,825 A 4/1955 Blakeman
2,708,762 A 5/1955 Kling et al.
2,796,620 A * 6/1957 Bressler ..... A46B 5/0025 15/201
2,797,424 A 7/1957 Olson

(56) References Cited

U.S. PATENT DOCUMENTS 2,882,544 A 4/1959 Hadidan
3,065,479 A 11/1962 McGee
3,103,027 A 9/1963 Birch
3,103,680 A 9/1963 Krichmar
3,129,449 A 4/1964 Bernard
3,152,349 A 10/1964 Brennesholtz
3,153,800 A 10/1964 Trotin
3,174,174 A 3/1965 Dengler
3,177,509 A 4/1965 Bernard
3,181,193 A 5/1965 Nobles et al.
3,185,001 A 5/1965 Viator
3,185,582 A 5/1965 Allegre
3,188,672 A 6/1965 Gary
3,195,537 A 7/1965 Blasi
3,196,299 A 7/1965 Kott
3,230,562 A 1/1966 Birch
3,242,516 A 3/1966 Cantor
3,253,292 A 5/1966 Herschensohn
3,254,356 A 6/1966 Yao et al.
3,258,805 A 7/1966 Rossnan
3,316,576 A 5/1967 Urbush
3,320,225 A 5/1967 Bradbury
3,337,893 A 8/1967 Fine et al.
3,398,421 A 8/1968 Abraham
D213,669 S 4/1969 Miller
3,509,874 A 5/1970 Stillman
3,553,759 A 1/1971 Kramer et al.
3,584,795 A 6/1971 Baird
3,599,916 A 8/1971 Szabo
3,610,043 A 10/1971 Wemyss
3,633,237 A 1/1972 Bagube
3,643,282 A 2/1972 Lechene et al.
3,722,020 A 3/1973 Hills
D226,942 S 5/1973 Okuda
3,739,419 A 6/1973 Natman et al.
3,766,590 A 10/1973 Wachtel
3,848,871 A 11/1974 Sweet et al.
3,900,550 A 8/1975 Oliver et al.
4,114,222 A 9/1978 Serediuk
4,121,798 A 10/1978 Schumacher et al.
D255,511 S 6/1980 Hill et al.
4,223,417 A 9/1980 Solow
4,240,452 A 12/1980 Jean
D258,143 S 2/1981 Flick
4,274,174 A 6/1981 Ertel
4,277,862 A 7/1981 Weideman
4,288,883 A 9/1981 Dolinsky
4,299,208 A 11/1981 Blanc
4,328,604 A 5/1982 Adams
4,356,585 A 11/1982 Protell et al.
4,364,142 A 12/1982 Pangle
4,369,284 A 1/1983 Chen
D269,141 S 5/1983 Eugay
D272,683 S 2/1984 Stocchi
D272,687 S 2/1984 Stocchi
D272,689 S 2/1984 Stocchi
D272,690 S 2/1984 Stocchi
4,432,114 A 2/1984 Goudsmit
D273,635 S 5/1984 Stocchi
4,455,704 A 6/1984 Williams
4,461,285 A 7/1984 Courtin
4,471,505 A 9/1984 Spademan
4,488,327 A 12/1984 Snider
4,488,328 A 12/1984 Hyman
4,493,126 A 1/1985 Uy
4,500,939 A 2/1985 Gueret
4,520,526 A 6/1985 Peters
4,535,014 A 8/1985 Wright
4,543,679 A 10/1985 Rosofsky et al.
4,563,381 A 1/1986 Woodland
4,566,145 A 1/1986 Wachtel
4,608,968 A 9/1986 Rosofsky
4,609,171 A 9/1986 Matsui
4,610,043 A 9/1986 Vezjak
4,618,213 A 10/1986 Chen
D287,072 S 12/1986 Pfleger
4,628,564 A 12/1986 Youssef
4,638,521 A 1/1987 Potente et al.
4,654,922 A 4/1987 Chen
4,691,405 A 9/1987 Reed
4,694,844 A 9/1987 Berl et al.
4,712,266 A 12/1987 Yamaki
4,712,267 A 12/1987 Cheng
4,712,304 A 12/1987 Sanelli
4,721,021 A 1/1988 Kusznir
D295,695 S 5/1988 Golzari
4,757,570 A 7/1988 Haeusser et al.
4,762,373 A 8/1988 Amos et al.
4,776,054 A * 10/1988 Rauch ..... A46B 9/04 15/110
4,783,869 A 11/1988 Lee
4,800,608 A 1/1989 Key
4,827,551 A 5/1989 Maser et al.
4,829,621 A 5/1989 Phenegar
4,852,832 A 8/1989 Delaney
4,888,844 A 12/1989 Maggs
4,901,212 A 2/1990 Prickett
D309,528 S 7/1990 Valenti
5,001,803 A 3/1991 Discko, Jr.
5,005,246 A 4/1991 Yen-Hui
D317,986 S 7/1991 Huang
5,027,796 A 7/1991 Linzey
5,032,082 A 7/1991 Herrera
5,040,260 A 8/1991 Michaels
5,052,071 A 10/1991 Halm
5,054,154 A 10/1991 Schiffer et al.
5,067,061 A 11/1991 Prickett
5,070,567 A 12/1991 Holland
5,114,214 A 5/1992 Barman
5,120,225 A 6/1992 Amit
5,121,894 A 6/1992 Twork, Sr. et al.
5,141,192 A 8/1992 Adams
5,146,645 A 9/1992 Dirksing
5,165,761 A 11/1992 Dirksing
5,176,427 A 1/1993 Weihrauch
5,184,368 A 2/1993 Holland
D334,288 S 3/1993 Witzig-Jaggi
D335,579 S 5/1993 Chuang
5,226,197 A 7/1993 Nack et al.
5,228,466 A 7/1993 Klinkhammer
5,230,118 A 7/1993 Chamma
5,242,235 A 9/1993 Li
5,249,327 A 10/1993 Hing
D340,808 S 11/1993 Sherman et al.
5,262,468 A 11/1993 Chen
5,269,038 A * 12/1993 Bradley ..... A46B 5/0025 15/167.1
5,273,425 A 12/1993 Hoagland
D345,256 S 3/1994 Khin
5,305,489 A 4/1994 Lage
5,305,492 A 4/1994 Giuliani et al.
5,311,414 A 5/1994 Branham, Sr.
5,323,504 A 6/1994 McCusker
D348,986 S 7/1994 Ross
5,325,560 A 7/1994 Pavone et al.
5,336,708 A 8/1994 Chen
5,339,482 A 8/1994 Desimone et al.
D350,851 S 9/1994 Spence, Jr.
5,351,358 A 10/1994 Larrimore
5,353,460 A 10/1994 Bauman
5,355,546 A 10/1994 Scheier et al.
5,360,026 A 11/1994 Klinkhammer
5,371,915 A 12/1994 Key
5,373,602 A 12/1994 Bang
D354,881 S 1/1995 Huff
5,390,984 A 2/1995 Boucherie et al.
5,392,483 A 2/1995 Heinzelman et al.
5,393,796 A 2/1995 Halberstadt et al.
5,396,678 A 3/1995 Bredall et al.
5,398,366 A 3/1995 Bradley
5,398,369 A 3/1995 Heinzelman et al.
5,416,942 A 5/1995 Baldacci et al.
D358,938 S 6/1995 Schneider et al.
5,438,726 A 8/1995 Leite

(56) References Cited

U.S. PATENT DOCUMENTS 5,445,825 A 8/1995 Copelan et al.
5,454,133 A 10/1995 Garnet
5,465,450 A 11/1995 Humphries
5,481,775 A 1/1996 Gentile et al.
5,483,722 A 1/1996 Scheier et al.
5,491,866 A 2/1996 Simonds
D368,163 S 3/1996 Overthun
5,497,526 A 3/1996 Klinkhammer
5,502,930 A 4/1996 Burkette et al.
5,504,959 A 4/1996 Yukawa et al.
5,508,334 A 4/1996 Chen
5,511,273 A 4/1996 Carroll
5,511,275 A 4/1996 Volpenhein et al.
5,511,277 A 4/1996 Simonds
5,524,319 A 6/1996 Avidor
5,528,786 A 6/1996 Porat et al.
D371,680 S 7/1996 Juhlin et al.
5,530,981 A 7/1996 Chen
5,535,474 A 7/1996 Salazar
5,546,624 A 8/1996 Bock
D375,206 S 11/1996 Halm
5,570,487 A 11/1996 Schneider
D376,695 S 12/1996 Tveras
5,581,840 A 12/1996 Chen
5,584,690 A 12/1996 Maassarani
5,604,951 A 2/1997 Shipp
5,607,230 A 3/1997 Protz, Jr.
5,613,262 A 3/1997 Choy-Maldonado
5,618,882 A 4/1997 Hammond et al.
5,625,916 A 5/1997 McDougall
5,628,082 A 5/1997 Moskovich
5,630,244 A 5/1997 Chang
5,633,286 A 5/1997 Chen
5,639,049 A 6/1997 Jennings et al.
5,651,158 A 7/1997 Halm
D382,407 S 8/1997 Craft et al.
5,673,452 A 10/1997 Chang et al.
5,673,454 A 10/1997 Quintanilla et al.
D386,313 S 11/1997 Moskovich
5,689,850 A 11/1997 Shekalim
D386,905 S 12/1997 Brady et al.
5,709,004 A 1/1998 Paduano et al.
D390,706 S 2/1998 Hohlbein et al.
D391,769 S 3/1998 Kling et al.
5,735,011 A 4/1998 Asher
5,735,012 A 4/1998 Heinzelman et al.
5,735,864 A 4/1998 Heisinger, Jr.
5,742,972 A 4/1998 Bredall et al.
5,758,380 A 6/1998 Vrignaud
5,758,383 A 6/1998 Hohlbein
5,765,252 A 6/1998 Carr
5,766,193 A 6/1998 Millner
D396,288 S 7/1998 Samuel
5,774,923 A 7/1998 Halm
5,778,475 A 7/1998 Garcia
5,778,476 A 7/1998 Squillaci et al.
5,779,654 A 7/1998 Foley et al.
5,781,958 A 7/1998 Meessmann et al.
D397,219 S 8/1998 Rangel et al.
5,792,159 A 8/1998 Amin
5,799,354 A * 9/1998 Amir ..... A46B 5/0025 15/167.1
5,802,656 A * 9/1998 Dawson ..... A46B 5/0029 15/110
5,810,856 A 9/1998 Tveras
5,813,079 A 9/1998 Halm
D399,349 S 10/1998 Barth
5,816,687 A 10/1998 Tapp
5,817,114 A 10/1998 Anderson et al.
5,818,856 A 10/1998 Injeyan et al.
5,823,655 A 10/1998 Brooks
RE35,941 E 11/1998 Stansbury, Jr.
D401,069 S 11/1998 Lamond et al.
5,836,030 A 11/1998 Hazeu et al.
5,836,033 A 11/1998 Berge
5,839,148 A 11/1998 Volpenhein
5,839,149 A 11/1998 Scheier et al.
D402,116 S 12/1998 Magloff et al.
5,842,247 A 12/1998 Decesare
5,845,358 A 12/1998 Woloch
5,848,838 A 12/1998 Presta
D403,510 S 1/1999 Menke et al.
D404,205 S 1/1999 Hohlbein
D404,206 S 1/1999 Hohlbein
5,860,183 A 1/1999 Kam
D405,272 S 2/1999 Khalaj et al.
D407,221 S 3/1999 Van Gelder
D407,222 S 3/1999 Van Gelder
D407,223 S 3/1999 Van Gelder
5,875,510 A 3/1999 Lamond et al.
5,896,614 A 4/1999 Flewitt
5,908,038 A 6/1999 Bennett
5,913,346 A 6/1999 Narwani
5,915,433 A 6/1999 Hybler
D412,064 S 7/1999 Achepohl et al.
5,920,941 A 7/1999 Iannotta
5,926,901 A 7/1999 Tseng et al.
5,928,254 A 7/1999 Jensen
5,930,860 A 8/1999 Shipp
5,938,673 A 8/1999 DePierro et al.
D413,728 S 9/1999 Waguespack et al.
5,946,758 A 9/1999 Hohlbein et al.
5,946,759 A 9/1999 Cann
5,951,578 A 9/1999 Jensen
5,956,797 A * 9/1999 Wilson ..... A46B 5/0012 15/167.1
5,957,942 A 9/1999 Yudelman
D415,352 S 10/1999 Beals et al.
5,964,009 A 10/1999 Hoepfl et al.
5,967,152 A 10/1999 Rimkus
5,970,564 A * 10/1999 Inns ..... A46B 7/06 15/167.1
D416,685 S 11/1999 Overthun
5,974,614 A 11/1999 Ross
5,980,541 A 11/1999 Tenzer
5,980,542 A 11/1999 Saldivar
5,984,935 A 11/1999 Welt et al.
5,987,688 A 11/1999 Roberts et al.
5,987,690 A 11/1999 Heuler
5,991,958 A 11/1999 Hohlbein
5,991,959 A 11/1999 Raven et al.
6,000,083 A 12/1999 Blaustein et al.
6,003,189 A 12/1999 Falleiros
6,004,334 A 12/1999 Mythen
6,006,395 A 12/1999 Tiramani et al.
D418,979 S 1/2000 Moskovich et al.
D418,981 S 1/2000 Cheong et al.
D419,304 S 1/2000 Moskovich et al.
6,015,293 A 1/2000 Rimkus
D419,773 S 2/2000 Beals et al.
D420,515 S 2/2000 Van Gelder
D420,802 S 2/2000 Cheong et al.
D420,804 S 2/2000 Juhlin et al.
D421,184 S 2/2000 Koh et al.
D421,841 S 3/2000 Achepohl et al.
D421,843 S 3/2000 Joergensen
D421,844 S 3/2000 Stark et al.
6,032,313 A 3/2000 Tsang
6,032,315 A 3/2000 Liebel
6,041,467 A 3/2000 Roberts et al.
D422,413 S 4/2000 Goldinger et al.
6,049,936 A 4/2000 Holley
6,050,709 A 4/2000 Hastings
D423,785 S 5/2000 Karallis
D423,786 S 5/2000 Zelinski
D423,787 S 5/2000 Musciano
D424,808 S 5/2000 Beals et al.
D424,809 S 5/2000 Bernard
D425,306 S 5/2000 Beals et al.
6,058,541 A 5/2000 Masterman et al.
6,066,282 A 5/2000 Kramer
6,070,286 A 6/2000 Cardarelli
6,073,299 A 6/2000 Hohlbein
6,076,223 A 6/2000 Dair et al.

(56) References Cited

U.S. PATENT DOCUMENTS

D427,437 S 7/2000 Vonarburg
6,088,870 A 7/2000 Hohlbein
D428,702 S 8/2000 Van Gelder
D429,566 S 8/2000 Yoshimoto et al.
D429,567 S 8/2000 Yoshimoto et al.
6,098,233 A 8/2000 Chen
6,101,659 A 8/2000 Halm
6,105,191 A 8/2000 Chen et al.
6,108,849 A 8/2000 Weihrauch
6,108,851 A 8/2000 Bredall et al.
6,108,869 A 8/2000 Meessmann et al.
6,115,870 A 9/2000 Solanki et al.
6,119,296 A 9/2000 Noe et al.
6,128,808 A 10/2000 Jansson et al.
6,131,228 A 10/2000 Chen et al.
6,141,817 A 11/2000 Dawson
6,151,745 A 11/2000 Roberts et al.
D434,906 S 12/2000 Beals et al.
6,161,245 A 12/2000 Weihrauch
6,171,323 B1 1/2001 Potti et al.
6,178,582 B1 * 1/2001 Halm ..... A46B 5/0025 15/167.1
6,179,503 B1 1/2001 Taghavi-Khanghah
D437,486 S 2/2001 Francos
6,185,779 B1 2/2001 Kramer
D439,412 S 3/2001 Volpenhein et al.
6,205,611 B1 3/2001 Vigil
D440,767 S 4/2001 Moskovich et al.
6,219,874 B1 4/2001 Van Gelder et al.
D441,958 S 5/2001 Rueb
6,230,356 B1 5/2001 Hyo-Moon
6,237,178 B1 5/2001 Krammer et al.
D443,142 S 6/2001 Harada
6,254,390 B1 7/2001 Wagner
6,260,227 B1 7/2001 Fulop
6,266,840 B1 7/2001 Munro
D446,021 S 8/2001 Jen
D447,238 S 8/2001 Tang
6,273,719 B1 8/2001 Whitman
6,276,021 B1 8/2001 Hohlbein
D448,174 S 9/2001 Harris et al.
6,289,545 B1 9/2001 Molster
6,290,496 B1 9/2001 Azar et al.
D448,569 S 10/2001 Harris et al.
D448,570 S 10/2001 Harris et al.
D448,571 S 10/2001 Harris et al.
6,298,516 B1 10/2001 Beals et al.
6,308,358 B2 10/2001 Gruber et al.
D450,457 S 11/2001 Hohlbein
D450,928 S 11/2001 Weisbarth
6,311,358 B1 11/2001 Soetewey et al.
6,311,360 B1 11/2001 Lanvers
6,314,605 B1 11/2001 Solanki et al.
6,314,606 B1 11/2001 Hohlbein
6,319,332 B1 11/2001 Gavney, Jr. et al.
6,322,362 B1 11/2001 Holms
6,322,573 B1 11/2001 Murayama
6,325,626 B1 12/2001 Blass
6,327,735 B1 12/2001 Kramer
6,332,233 B1 12/2001 Proulx
D452,615 S 1/2002 Cheong et al.
6,338,176 B1 1/2002 Smith et al.
6,338,460 B1 1/2002 Rumpel
D453,270 S 2/2002 Choong
6,345,405 B1 2/2002 Brackin
D453,998 S 3/2002 Ping
D454,252 S 3/2002 Lee
6,352,545 B1 3/2002 Wagner
6,353,958 B2 3/2002 Weihrauch
6,360,395 B2 3/2002 Blaustein et al.
6,360,398 B1 3/2002 Wiegner et al.
RE37,625 E 4/2002 Wieder et al.
D456,139 S 4/2002 Hohlbein
6,374,448 B2 4/2002 Seifert
D456,607 S 5/2002 Carlucci et al.
D457,323 S 5/2002 Hohlbein
D457,325 S 5/2002 Wilson et al.
6,383,202 B1 5/2002 Rosenblood et al.
D458,453 S 6/2002 Baertschi
D459,086 S 6/2002 Belton et al.
D459,087 S 6/2002 Pfleger
6,402,768 B1 6/2002 Liebel
6,408,476 B1 6/2002 Cann
6,408,524 B1 6/2002 Lai
6,421,867 B1 7/2002 Weihrauch
D461,313 S 8/2002 Hohlbein
D461,959 S 8/2002 Chan et al.
6,440,149 B1 8/2002 Potti
D462,178 S 9/2002 Moskovich et al.
D462,527 S 9/2002 Ping
D462,528 S 9/2002 Crossman et al.
D463,131 S 9/2002 Winter et al.
D463,132 S 9/2002 Winter et al.
D463,133 S 9/2002 Hohlbein
6,442,786 B2 9/2002 Hahm et al.
6,446,295 B1 9/2002 Calabrese
D463,668 S 10/2002 Yoshimoto et al.
D464,796 S 10/2002 Winter et al.
6,463,618 B1 10/2002 Zimmer
6,463,619 B2 10/2002 Gavney, Jr.
D465,847 S 11/2002 Jacobs
D466,302 S 12/2002 Ping
D467,430 S 12/2002 Ping
6,494,594 B1 12/2002 Schroetter
6,496,999 B1 12/2002 Gleason et al.
6,505,373 B2 1/2003 Van Gelder et al.
D469,958 S 2/2003 Saindon et al.
6,513,182 B1 2/2003 Calabrese et al.
6,514,445 B1 2/2003 Cann et al.
D471,276 S 3/2003 Potti
D471,362 S 3/2003 Moskovich et al.
6,546,586 B2 4/2003 Cho
6,553,604 B1 4/2003 Braun et al.
D474,608 S 5/2003 Hohlbein
6,564,416 B1 5/2003 Claire et al.
D475,531 S 6/2003 Klimeck et al.
D476,158 S 6/2003 Ling
6,571,417 B1 6/2003 Gavney, Jr. et al.
D476,487 S 7/2003 Saindon et al.
D477,465 S 7/2003 Reilly et al.
6,599,048 B2 7/2003 Kuo
D478,211 S 8/2003 Ping
D478,213 S 8/2003 Ping
D478,424 S 8/2003 Saindon et al.
D478,425 S 8/2003 Ping
D478,727 S 8/2003 Wong
D478,728 S 8/2003 Wong
6,601,272 B2 8/2003 Stvartak et al.
D479,046 S 9/2003 Winkler
D479,047 S 9/2003 Wong
D479,914 S 9/2003 Choong
6,625,839 B2 9/2003 Fischer
D480,213 S 10/2003 Ping
D480,214 S 10/2003 Kling et al.
D480,877 S 10/2003 Crossman et al.
D482,199 S 11/2003 De Salvo
6,641,764 B2 11/2003 Lanvers
6,647,581 B1 11/2003 Persad et al.
D483,183 S 12/2003 De Salvo
D483,184 S 12/2003 Geiberger et al.
D483,568 S 12/2003 Jamson
D483,569 S 12/2003 Wong
6,654,979 B2 12/2003 Calabrese
D485,989 S 2/2004 Winkler et al.
D486,649 S 2/2004 Sprosta et al.
6,687,940 B1 2/2004 Gross et al.
D487,195 S 3/2004 Winkler
6,708,364 B1 3/2004 Huber
D488,621 S 4/2004 Wong
6,729,789 B2 5/2004 Gordon
6,735,804 B2 5/2004 Carlucci et al.
6,779,851 B2 8/2004 Bouchiere
6,792,642 B2 9/2004 Wagstaff
6,799,346 B2 10/2004 Jeng et al.

(56) References Cited

U.S. PATENT DOCUMENTS

| | | | |
|---|---|---|---|
| 6,802,097 | B2 | 10/2004 | Hafliger et al. |
| 6,817,054 | B2 | 11/2004 | Moskovich et al. |
| 6,820,299 | B2 | 11/2004 | Gavney, Jr. |
| D501,084 | S | 1/2005 | Schaefer et al. |
| 6,859,969 | B2 | 3/2005 | Gavney, Jr. et al. |
| 6,865,767 | B1 | 3/2005 | Gavney, Jr. |
| D503,538 | S | 4/2005 | De Salvo |
| 6,886,207 | B1 | 5/2005 | Solanki |
| 6,895,629 | B1 | 5/2005 | Wenzler |
| 6,931,688 | B2 | 8/2005 | Moskovich et al. |
| 6,938,294 | B2 | 9/2005 | Fattori et al. |
| 6,988,777 | B2 | 1/2006 | Pfenniger et al. |
| D517,812 | S | 3/2006 | Hohlbein et al. |
| 7,020,928 | B2 | 4/2006 | Hohlbein |
| 7,036,179 | B1 | 5/2006 | Weihrauch |
| 7,047,591 | B2 | 5/2006 | Hohlbein |
| 7,143,462 | B2 | 12/2006 | Hohlbein |
| 7,360,270 | B2 | 4/2008 | Moskovich et al. |
| 7,607,189 | B2 | 10/2009 | Moskovich |
| 7,614,111 | B2 | 11/2009 | Moskovich et al. |
| 7,703,163 | B2 | 4/2010 | Jimenez et al. |
| 7,721,376 | B2 | 5/2010 | Hohlbein et al. |
| 7,725,981 | B2 | 6/2010 | Moskovich et al. |
| 7,757,326 | B2 | 7/2010 | Jimenez et al. |
| 7,841,041 | B2 | 11/2010 | Moskovich et al. |
| 7,845,042 | B2 | 12/2010 | Moskovich et al. |
| 8,220,102 | B2 | 7/2012 | Clos et al. |
| 8,393,042 | B2 | 3/2013 | Moskovich et al. |
| 8,533,891 | B2 | 9/2013 | Waguespack |
| 2001/0001334 | A1 | 5/2001 | Gruber et al. |
| 2001/0013151 | A1 | 8/2001 | Gelder et al. |
| 2001/0023516 | A1 | 9/2001 | Driesen et al. |
| 2001/0041903 | A1 | 11/2001 | Richard |
| 2001/0042280 | A1 | 11/2001 | Moskovich et al. |
| 2001/0047556 | A1 | 12/2001 | Weihrauch |
| 2002/0004964 | A1 | 1/2002 | Luchino et al. |
| 2002/0015612 | A1 | 2/2002 | Aoyama |
| 2002/0019645 | A1 | 2/2002 | Fischer et al. |
| 2002/0100134 | A1 | 8/2002 | Dunn et al. |
| 2002/0108194 | A1 | 8/2002 | Carlucci et al. |
| 2002/0120991 | A1 | 9/2002 | Cacka et al. |
| 2002/0124333 | A1 | 9/2002 | Hafliger et al. |
| 2002/0124337 | A1 | 9/2002 | Calabrese et al. |
| 2002/0138926 | A1 | 10/2002 | Brown, Jr. et al. |
| 2002/0138928 | A1 | 10/2002 | Calabrese |
| 2002/0138931 | A1 | 10/2002 | Davies |
| 2002/0170145 | A1 | 11/2002 | Stvartak et al. |
| 2003/0009837 | A1 | 1/2003 | Cann |
| 2003/0033679 | A1 | 2/2003 | Fattori et al. |
| 2003/0066145 | A1 | 4/2003 | Prineppi |
| 2003/0077107 | A1 | 4/2003 | Kuo |
| 2003/0084525 | A1 | 5/2003 | Blaustein et al. |
| 2003/0115699 | A1 | 6/2003 | Wagstaff |
| 2003/0115705 | A1 | 6/2003 | Aoyama et al. |
| 2003/0116884 | A1 | 6/2003 | Wagstaff |
| 2003/0159224 | A1 | 8/2003 | Fischer et al. |
| 2003/0163149 | A1 | 8/2003 | Heisinger, Jr. |
| 2003/0167582 | A1 | 9/2003 | Fischer et al. |
| 2003/0182744 | A1 | 10/2003 | Fattori et al. |
| 2003/0196283 | A1 | 10/2003 | Eliav et al. |
| 2003/0208865 | A1 | 11/2003 | Davies |
| 2003/0216762 | A1 | 11/2003 | Levit |
| 2003/0229959 | A1 | 12/2003 | Gavney et al. |
| 2004/0006837 | A1 | 1/2004 | Cann |
| 2004/0010876 | A1 | 1/2004 | Kraemer |
| 2004/0025272 | A1 | 2/2004 | Stvartak et al. |
| 2004/0025274 | A1 | 2/2004 | Moskovich et al. |
| 2004/0025275 | A1 | 2/2004 | Moskovich et al. |
| 2004/0031115 | A1 | 2/2004 | Gavney, Jr. |
| 2004/0060137 | A1 | 4/2004 | Eliav et al. |
| 2004/0068810 | A1 | 4/2004 | Lee |
| 2004/0134007 | A1 | 7/2004 | Davies |
| 2004/0168269 | A1 | 9/2004 | Kunita et al. |
| 2004/0177462 | A1 | 9/2004 | Brown, Jr. et al. |
| 2004/0200016 | A1 | 10/2004 | Chan et al. |
| 2004/0200748 | A1 | 10/2004 | Klassen et al. |
| 2004/0221409 | A1 | 11/2004 | Gavney, Jr. |
| 2004/0231076 | A1 | 11/2004 | Gavney, Jr. |
| 2004/0237236 | A1 | 12/2004 | Gavney, Jr. |
| 2004/0255416 | A1 | 12/2004 | Hohlbein |
| 2005/0000043 | A1 | 1/2005 | Chan et al. |
| 2005/0000049 | A1 | 1/2005 | Hohlbein |
| 2005/0015904 | A1 | 1/2005 | Gavney, Jr. |
| 2005/0038461 | A1 | 2/2005 | Phillips |
| 2005/0069372 | A1 | 3/2005 | Hohlbein et al. |
| 2005/0188489 | A1 | 9/2005 | Hohlbein |
| 2006/0026784 | A1 | 2/2006 | Moskovich |
| 2006/0064833 | A1 | 3/2006 | Jacobs |
| 2007/0277339 | A1 | 12/2007 | Barsheshet |

FOREIGN PATENT DOCUMENTS

| | | | |
|---|---|---|---|
| CH | 460705 | | 8/1968 |
| CN | 1150748 | | 5/1997 |
| CN | 1207655 | | 2/1999 |
| CN | 99225704.2 | | 11/1999 |
| CN | 1406119 | | 3/2003 |
| CN | 2607847 | | 3/2004 |
| DE | 857128 | | 11/1952 |
| DE | 1657299 | | 2/1971 |
| DE | 2930459 | | 2/1981 |
| DE | 3114507 | | 3/1983 |
| DE | 3639424 | | 6/1988 |
| DE | 3840136 | | 5/1990 |
| DE | 4122524 | | 2/1992 |
| DE | 9319232 | | 3/1994 |
| DE | 9416395 | | 12/1994 |
| DE | 4412301 | | 10/1995 |
| DE | 29822826 | | 12/1998 |
| DE | 29821121 | | 3/1999 |
| DE | 19817704 | | 10/1999 |
| DE | 19949671 | | 4/2001 |
| DE | 20109123 | | 5/2001 |
| DE | 20107614 | | 9/2002 |
| DE | 10122987 | | 11/2002 |
| DE | 202005009026 | | 10/2005 |
| EP | 0336641 | | 10/1989 |
| EP | 0360766 | | 3/1990 |
| EP | 0371293 | | 6/1990 |
| EP | 0454625 | | 10/1991 |
| EP | 0460610 | | 12/1991 |
| EP | 0613636 | | 9/1994 |
| EP | 0648448 | | 4/1995 |
| EP | 0875169 | | 11/1998 |
| EP | 0930030 | | 7/1999 |
| EP | 1034721 | | 9/2000 |
| EP | 1059049 | | 12/2000 |
| EP | 1308108 | | 5/2003 |
| EP | 1350442 | | 10/2003 |
| EP | 1486137 | | 6/2004 |
| FR | 38440 | | 6/1931 |
| FR | 707727 | | 7/1931 |
| FR | 777340 | | 2/1935 |
| FR | 2594307 | | 8/1987 |
| FR | 2652245 | | 3/1991 |
| GB | 191117643 | | 4/1912 |
| GB | 189335 | | 11/1922 |
| GB | 304459 | | 1/1929 |
| GB | 412414 | | 6/1934 |
| GB | 480845 | | 3/1938 |
| GB | 495982 | | 11/1938 |
| GB | 524135 | | 7/1940 |
| GB | 647924 | | 12/1950 |
| GB | 2371217 | | 7/2002 |
| GB | 2391462 | | 2/2004 |
| JP | 401214306 | A | 8/1989 |
| JP | 5076416 | A | 3/1993 |
| JP | 408322641 | A | 12/1996 |
| JP | 2000-000118 | A | 1/2000 |
| JP | 2000-308522 | A | 11/2000 |
| JP | 2001-190333 | A | 7/2001 |
| JP | 2001-314232 | A | 11/2001 |
| JP | 2002-010832 | | 1/2002 |
| JP | 2000-278899 | A | 2/2002 |

(56) References Cited

FOREIGN PATENT DOCUMENTS

| | | | |
|---|---|---|---|
| JP | 2002-142867 | A | 5/2002 |
| JP | 2002-191436 | A | 7/2002 |
| JP | 2002-223853 | A | 8/2002 |
| MX | PA02006372 | A | 7/1997 |
| NL | 45152 | | 9/1938 |
| RU | 2048132 | | 6/1992 |
| RU | 2039518 | | 7/1995 |
| RU | 2241363 | | 3/2004 |
| SU | 1708283 | | 1/1992 |
| WO | WO 90/01281 | | 2/1990 |
| WO | WO 92/17092 | | 10/1992 |
| WO | WO 92/17093 | | 10/1992 |
| WO | WO 94/05183 | | 3/1994 |
| WO | WO 94/09678 | | 5/1994 |
| WO | WO 96/02165 | | 2/1996 |
| WO | WO 96/15696 | | 5/1996 |
| WO | WO 97/25899 | | 7/1997 |
| WO | WO 97/25900 | | 7/1997 |
| WO | WO 98/02062 | | 1/1998 |
| WO | WO 98/05241 | | 2/1998 |
| WO | WO 98/07349 | | 2/1998 |
| WO | WO 98/08458 | | 3/1998 |
| WO | WO 98/09573 | | 3/1998 |
| WO | WO 98/18364 | | 5/1998 |
| WO | WO 98/25500 | | 6/1998 |
| WO | WO 99/37181 | | 7/1999 |
| WO | WO 99/37182 | | 7/1999 |
| WO | WO 99/49754 | | 10/1999 |
| WO | WO 00/49911 | | 8/2000 |
| WO | WO 00/53054 | | 9/2000 |
| WO | WO 00/64306 | | 11/2000 |
| WO | WO 00/64307 | | 11/2000 |
| WO | WO 00/76369 | | 12/2000 |
| WO | WO 01/17433 | | 3/2001 |
| WO | WO 01/45573 | | 6/2001 |
| WO | WO 01/80686 | | 11/2001 |
| WO | WO 01/91603 | | 12/2001 |
| WO | WO 02/062174 | | 8/2002 |
| WO | WO 02/071967 | | 9/2002 |
| WO | WO 02/087464 | | 11/2002 |
| WO | WO 03/005855 | | 1/2003 |
| WO | WO 03/020159 | | 3/2003 |
| WO | WO 03/030680 | | 4/2003 |
| WO | WO 03/037210 | | 5/2003 |
| WO | WO 03/043459 | | 5/2003 |
| WO | WO 03/090639 | | 11/2003 |
| WO | WO 2004/014181 | | 2/2004 |
| WO | WO 2004/014182 | | 2/2004 |
| WO | WO 2004/019801 | | 3/2004 |
| WO | WO 2004/026162 | | 4/2004 |
| WO | WO 2004/028235 | | 4/2004 |
| WO | WO 2004/082428 | | 9/2004 |
| WO | WO 2005/084486 | | 9/2005 |

OTHER PUBLICATIONS

Himont U.S.A. Inc., 1989, "Guide for Injection Molding", Pro-fax polypropylene.

Spencer Chemical Co., 1963, "The Integral Hinge", "Poly-Pro", Polypropylene.

* cited by examiner

TOOTHBRUSH

CROSS-REFERENCE TO RELATED PATENT APPLICATIONS

The present application is a continuation of U.S. Patent Application Ser. No. 13/647,005, filed Oct. 8, 2012, which is: (1) a continuation-in-part of U.S. patent application Ser. No. 11/535,259, filed Sep. 26, 2006, now U.S. Pat. No. 8,533,891 issued Sep. 17, 2013, which in turn claims the benefit of U.S. Provisional Patent Application Ser. No. 60/720,418, filed Sep. 26, 2005; and (2) a continuation-in-part of U.S. patent application Ser. No. 12/576,445, filed Oct. 9, 2009, now U.S. Pat. No. 8,393,042 issued Mar. 12, 2013, which in turn is a continuation-in-part of U.S. patent application Ser. No. 11/053,589, filed Feb. 8, 2005, now U.S. Pat. No. 7,725,981, issued Jun. 1, 2010, which in turn is a continuation of Patent Cooperation Treaty Patent Application Serial No. PCT/US2003/024879, filed Aug. 8, 2003, which in turn claims the benefit of U.S. Provisional Patent Application Ser. No. 60/402,165, filed Aug. 9, 2002. The entireties of the above-referenced patent applications are hereby incorporated by reference.

BACKGROUND

Conventional toothbrushes usually include a substantially rigid head with an outer surface from which cleaning elements extend. Conventional cleaning elements include bristles arranged in bristle tufts, elastomeric members or other known cleaning elements. However, rigid portions of certain conventional toothbrush heads can prevent the cleaning elements from being comfortably received in the mouth, and thereby prevent effective cleaning of the oral cavity.

To eliminate the problems associated with large, rigid toothbrush heads, certain conventional toothbrush heads include flexible segments that allow carried cleaning elements to move relative to the head. However, these flexible segments may not fit comfortably within the mouth of the user. Similarly, because of the size and/or shape of the flexible segments, the heads may not be comfortably manipulated within the mouth of the user during cleaning. As a result, the toothbrush may not be used on a regular basis. Additionally, when introduced into the mouth, the toothbrush may not be used for a period of time sufficient to provide the person with effective oral cleaning. It is also possible that the cleaning elements may not be capable of reaching all intended portions of the mouth. This can result in poor oral hygiene that can cause tooth and/or gum disease.

A number of approaches have been taken in the prior art to provide flexibility to the bristles during use of a toothbrush. U.S. Pat. No. 5,970,564, for example, discloses a toothbrush having an elastomeric ridge wherein there is a center array of bristles and there is a side array of bristles mounted in elastomeric boots. A number of patents disclose a toothbrush head having sets of bristles, each of which is mounted to a non-rigid or elastic support element. Examples of these approaches are found in U.S. Pat. Nos. 1,770,195, 2,244,098, 6,161,245 and 6,311,360 and in French Patent No. 38440.

SUMMARY

In one embodiment, the invention can be a toothbrush comprising: a head comprising a base, a first flexible cleaning element support member extending from said base and comprising a first flexible stem and a first flexible support head having a portion overhanging a portion of said first flexible stem, and a second cleaning element support member spaced from said first cleaning element support member along said base and comprising a second flexible stem and a second flexible support head having an outer peripheral edge, a first portion of said outer peripheral edge of said second support head overhangs a portion of said second flexible stem and a second portion of said outer peripheral surface of said second support head is free of an overhang relative to said second flexible stem.

In another embodiment, the invention can be a toothbrush comprising: a handle; a head connected to said handle and extending along a longitudinal axis from a proximal end to a distal end, the head having: a body portion; a base member at a distal end of the head protruding outwardly from a front surface of the body portion, the base member being substantially non-movable relative to the body portion and comprising at least one outwardly extending tooth cleaning element; a plurality of pods, each of the plurality of pods comprising at least one outwardly extending cleaning element, each of the plurality of pods movable relative to the body portion and resilient so that the at least one cleaning element of said plurality of pods is movable from an initial position and being returnable to said initial position; and a channel separating adjacent ones of the plurality of pods so that each of the plurality of pods can move independent of one another.

In yet another embodiment, the invention can be a toothbrush comprising: a handle; a head connected to said handle, said head having a rigid body portion; a plurality of spaced pods extending outwardly from said body portion, each of said pods including a narrow resilient stem capable of moving from an initial position and being returnable to said initial position; a plate mounted to and across each of said stems, a plurality of cleaning elements mounted to and extending outwardly from each of said plates; and said stems being connected to each other by a support secured to said body portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
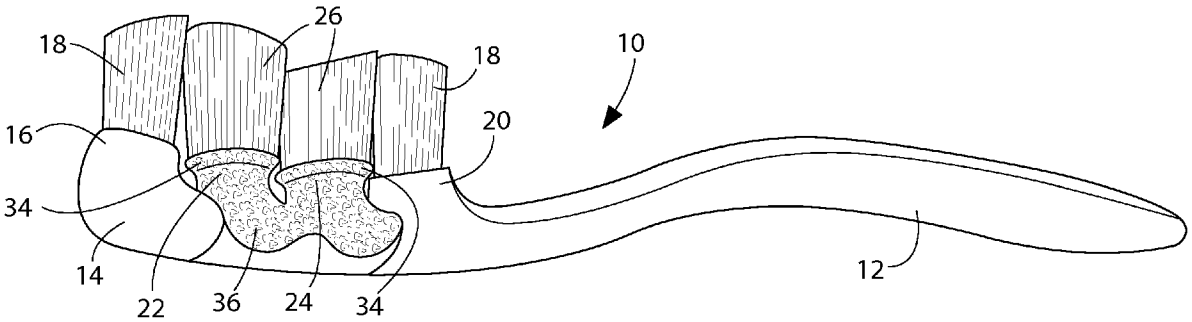
FIG. 1 is a perspective view of a toothbrush in accordance with this invention.

The following description of the preferred embodiment(s) is merely exemplary in nature and is in no way intended to limit the invention, its application, or uses.

FIGS. 1-4 illustrate a toothbrush 10 in accordance with one aspect of this invention. As shown therein toothbrush 10 includes an elongated hand-held handle 12 with a head 14 connected to and extending from the handle. The head 14 is divided into a plurality of separate cleaning areas which are spaced from each other. As illustrated the cleaning areas include a base member 16 located at the distal end of the head 14 and projecting outwardly from the main body portion 30 (which can also be considered a base 30) of the head. Base member 16 includes at least one and preferably a plurality of cleaning elements 18. Head 14 further includes a base member or supporting member 20 at the proximal end of head 14. Cleaning elements 18 also extend outwardly from base member 20.

Mounted between the cleaning areas which incorporate base members 16 and 20 are a pair of pods 22, 24. Each pod is provided with at least one and preferably a plurality of cleaning elements 26. As later described the pods 22, 24 have a greater degree of movability than do the base members 16, 20. In the preferred practice of the invention the pods 22, 24 are resilient members so that the pod cleaning elements add a motion range beyond the cleaning elements 18 which are generally static or non-movable. Preferably, because the various cleaning elements are separated from each other such as by channels 28 which extend completely across head 14 in a transverse direction and because of the elastic nature of pods 22, 24, the cleaning elements 26 are capable of 360 degrees rotation about the vertical axis of each individual pod. The angle of the bend is dictated by the ability of the material to bend.

Toothbrush 10 thus provides a head 14 wherein the front (distal end) and the back (proximal end) areas are in a relatively fixed position and wherein the cleaning elements, such as bristle strands, 18 do not have any extra degree of motion. The middle portion of head 14, however, has two areas of cleaning elements 26, 26 which are capable of 360 degree rotation.

Figure 4:
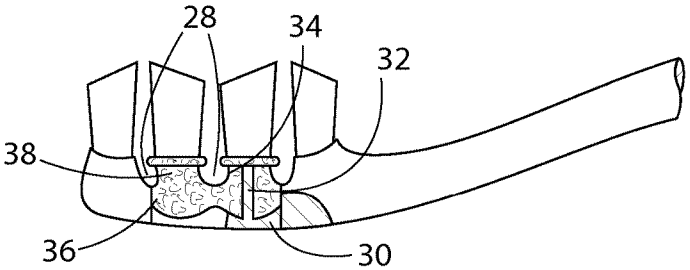
FIG. 4 is a side elevational view similar to FIG. 2 partially broken away.

As best shown in FIG. 4 the head 14 includes a main body portion/base 30 which supports the base members and pods. Body portion/base 30 and base members 16 and 20 are preferably made from conventional hard plastic materials, such as polypropylene, commonly used in the making of toothbrush handles and heads. Pods 22, 24, however, are made so as to be resilient. In the preferred practice of this invention, the resiliency of pods 22, 24 is achieved by providing a thin diameter beam 32 which extends from the main body portion/base 30 of the head of the toothbrush. Beam 32 is joined into the bottom of a thin pad or plate 34 which provides a support area onto which the cleaning elements 26 are affixed. The manner of mounting the cleaning elements 26 to the support pads 34 can be achieved utilizing various cleaning elements, such as bristles and other cleaning materials, in known attachment methods.

The desired flexibility or resiliency of the pods 22,24 is enhanced by enclosing the thin beams 32 in elastic material 36 which could be acquired during the multi-injection molding process. The elastic material 36 serves as a rubber band by returning the beams 32 to their original form or initial position. This return action creates an active motion in the opposite direction of the beam bend which aids in the cleaning of teeth by introducing extra brushing strokes.

Figure 2:
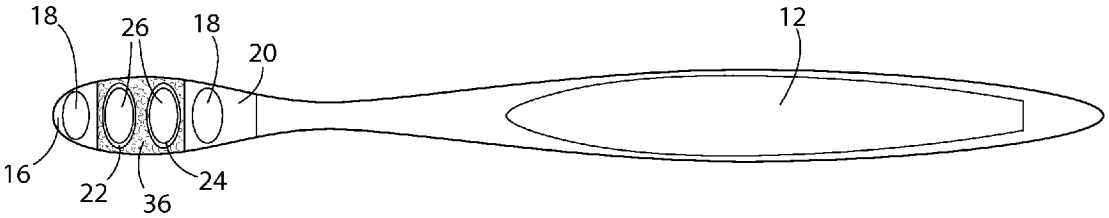
FIG. 2 is a side elevational view of the toothbrush shown in FIG. 1.

As best shown in FIGS. 1, 2 and 4 the pods 22, 24 include a widened portion disposed toward the body/base 30. The support pads 34 are also widened. Each pod has a narrow or reduced diameter central portion 38 longitudinally intermediate the length of each pod. Thus, each pod is of generally mushroom shape.

Beam 32 could be of any suitable shape such as having a cross-section which is circular, square or any other geometric shape that provides a thin dimension or thin diameter to the beam to facilitate the bendability of the beam. The elastomer 36 may be considered as a continuous layer of any suitable thickness which covers the entire central area of head 14 as illustrated so that both pods 22, 24 are incorporated as part of the same elastic material. The portion of the head 14 which includes pods 22, 24 may be formed as a separate subassembly similar to the subassembly later described with respect to FIGS. 5-6.

Although the invention could be practiced with a single base and a single pod and could be practiced with the base member having some, but a lesser degree of flexibility than the pod, the invention is preferably practiced wherein the base member is generally static or non-movable. In addition, the invention is preferably practiced where there are a plurality of such base members and a plurality of pods. The drawings illustrate a preferred practice of the invention where there are a total of four separate cleaning areas with the pods being located in the central portion of head 14. The invention is also preferably practiced where the cleaning elements comprise a plurality of bristles or strands on each base member and each pod.

Figure 3:
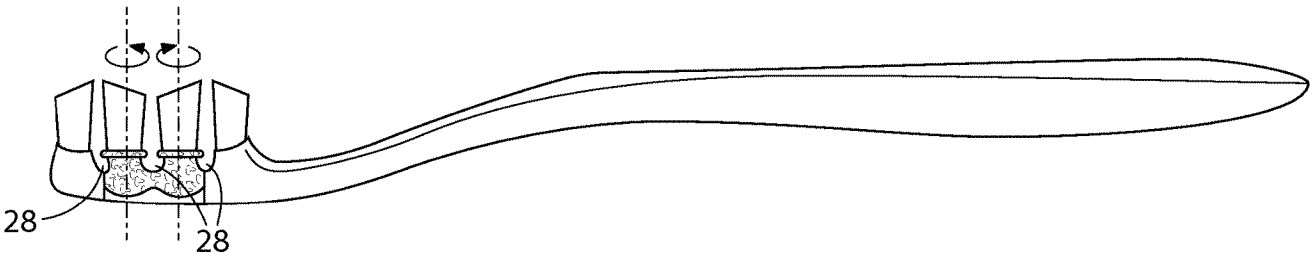
FIG. 3 is a front elevational view of the toothbrush shown in FIGS. 1-2.

As illustrated in FIG. 3 each base member 16 and 20 and each pod 22 and 24 has a generally oval outer surface. The base members and pods are longitudinally aligned, but spaced from each other by the depressions or open areas which form the channels 28. As also illustrated in FIG. 3 the pods have a larger outer surface or cleaning element carrying surface than do the base members.

As shown in FIG. 2 the terminal surfaces of the cleaning elements 18 and 26 are tapered so that the terminal surfaces of the cleaning elements 18 taper outwardly in a direction toward the center of head 14 while the terminal surfaces of cleaning elements 26 taper outwardly in a direction away from the center of head 14. Thus, the highest points of each set of cleaning elements 18 and its adjacent set of cleaning elements 26 are generally disposed toward each other for each pair of base member and pod 16, 22 and 20, 24.

Any suitable form of cleaning elements may be used as the cleaning elements 18 and 26 in the broad practice of this invention. The term "cleaning elements" is intended to be used in a generic sense which could include conventional fiber bristles or massage elements or other forms of cleaning elements such as elastomeric fingers or walls arranged in a circular cross-sectional shape or any type of desired shape including straight portions or sinusoidal portions. Where bristles are used, the bristles could be mounted to tuft blocks or sections by extending through suitable openings in the tuft blocks so that the base of the bristles is mounted within or below the tuft block.

Using different cleaning materials as cleaning elements of the toothbrushes may yield different effects. In an attempt to provide better stain removal a rubber-like material or elastomer can be used in combination with conventional bristles or used by itself to "brighten/whiten" the teeth.

It is to be understood that the specific illustration of the cleaning elements is merely for exemplary purposes. The invention can be practiced with various combinations of the same or different cleaning element configurations (such as stapled or in-molded technology bristles, etc.) and/or with the same bristle or cleaning element materials (such as nylon bristles, spiral bristles, rubber bristles, etc.) Similarly, while FIG. 2 illustrates the cleaning elements to be generally perpendicular to the outer surface of head 14, some or all of the cleaning elements may be angled at various angles with respect to the outer surface of head 14. It is thereby possible to select the combination of cleaning element configurations, materials and orientations to achieve specific intended results to deliver additional oral health benefits, like enhanced cleaning tooth polishing, tooth whitening and/or massaging of the gums.

Figure 5:
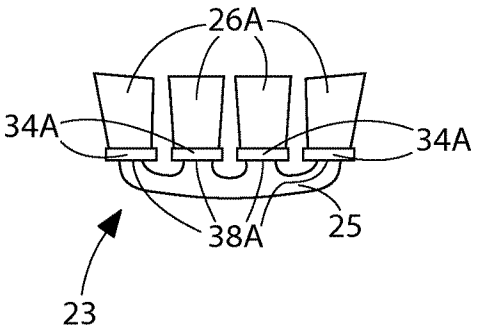
FIG. 5 is a side elevational view showing a subassembly of the bristle containing portion of the brush head in accordance with another aspect of this invention.
Figure 6:
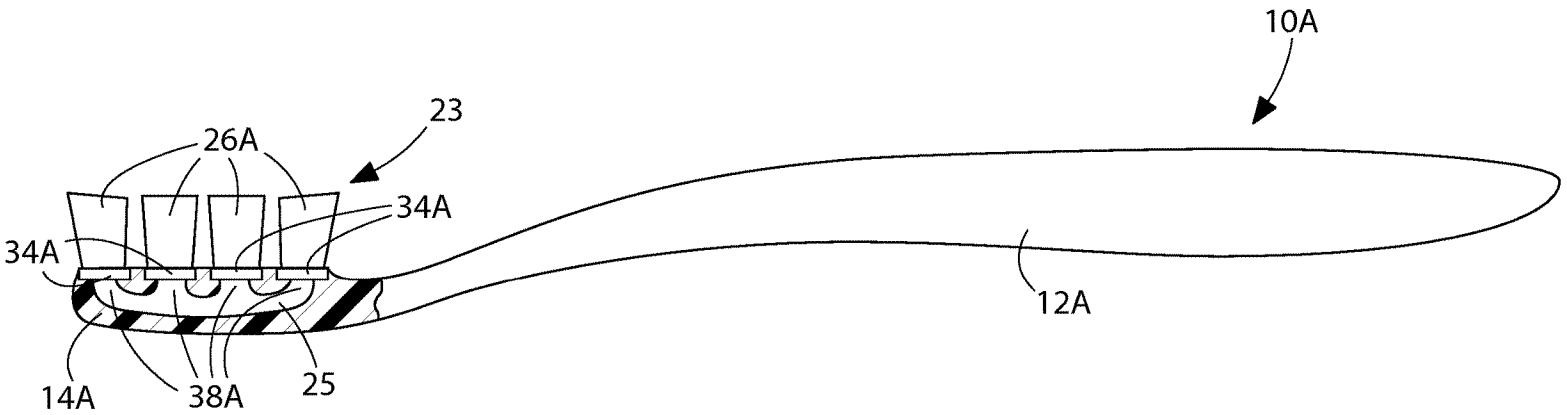
FIG. 6 is a side elevational view showing the subassembly of FIG. 5 incorporated in a completed toothbrush.

FIGS. 5-6 illustrate a further aspect of this invention relating to techniques for forming the toothbrush. The toothbrush 10A has the ability to provide flexible support for the bristles 26A in designated areas. The flexibility is provided by designing the tuft holding areas 34A as plates which in combination with the stems 38A forms pods of mushroom shape. The mushroom stem 38A is made flexible to allow the plate 34A populated with bristles or cleaning elements 26A to move in different directions while brushing, as described with respect to the flexible pods of FIGS. 1-4.

FIGS. 5-6 show the toothbrush 10A and in particular the cleaning element or bristle carrying portion 23 of the head 14A to be made utilizing an IMT process. As shown in FIG. 5 the bristle or cleaning element carrying portion 23 forms an initial subassembly. This subassembly is made by introducing the cleaning elements 26A into the mold cavity into which a plastic material is injected. As the material injected cools off it permanently traps the bristles or cleaning elements 26A to form a brush or subassembly 23.

To achieve a functional flexibility and proper tuft retention the portion of the bristle holding part or subassembly 23 which comprises the plates 34A, stems 38A and interconnecting support 25 is preferably a blend of polypropylene (PP) and soft TPE. Once the PP/TPE blend is combined with the bristles 26A the subassembly 23 is formed. In an initial independent IMT step the subassembly 23 is then overmolded with an entire toothbrush handle 12A and head 14A during a second injection cycle to form the completed toothbrush 10A shown in FIG. 6. If desired or required the entire handle 12A and head 14A absent the subassembly 23 could be made first and the subassembly or bristle retaining portion 23 made second.

Other IMT toothbrushes that have bristles attached to the bulk of the handle as known in the prior art are difficult to make because of the slow injection speed needed to fill the head of the toothbrush. The present invention permits the making of an entire handle at normal speeds by isolating the IMT process for making subassembly 23 to the smaller material shot size. Although a blend of PP/TPE is a preferred practice of this invention such blend is not required to make an IMT brush using the method of this invention. Similarly, the invention may be practiced using compatible materials to fuse the first and second shots so that the subassembly 23 created in one of the shots will be secured to the remainder of the toothbrush in the other shot. Thus, the two shots are mechanically trapped together to achieve essentially the same benefits as achieved by combining the subassembly 23 with the remainder of the toothbrush in a second injection cycle.

It is to be understood that the invention described in FIGS. 5-6 could be practiced where all portions of the head 14 include the flexible mushroom sections without having less flexible base portions such as base members 16 and 20 of FIGS. 1-4. Similarly, the subassembly two shot techniques of FIGS. 5-6 could be utilized in the embodiment of FIGS. 1-4 for forming the two or more central pods 22, 24 as a single subassembly initially made separate from the remainder of the toothbrush head 14. The final toothbrush would be made in a second injection molding process wherein the subassembly having interconnected pods 22,24 would be molded to the handle 12 and head 14 made of more rigid material.

As noted, FIG. 2 illustrates the terminal surfaces of the cleaning elements 18 and 26 to be tapered in an up and down or zig zag manner. FIGS. 5-6 show an alternative taper wherein the terminal surfaces form a smooth, gentle, concave shape. If desired, other shapes may be used such as a planar shape for the terminal surfaces or a convex shape as well as the zig zag or up and down shape shown in FIG. 2. Similarly, the terminal ends of the cleaning elements in the FIGS. 1-4 embodiment, as well as those of FIGS. 5-6, could have the various shapes such as zig-zag, convex, concave or planar.

Although FIGS. 1-4 and 5-6 illustrate a manually operated toothbrush, the invention may also be practiced where the head includes one or more power or electrically operated movable sections carrying cleaning elements. Such movable section may oscillate in a rotational manner or may oscillate linearly in a longitudinal direction with respect to the longitudinal axis of the head or may oscillate linearly in a lateral or transverse direction with respect to the longitudinal axis of the head. The movable section may oscillate in and out in a direction toward and away from the outer surface of the head. The movable section may rock back and forth with respect to the outer surface of the head. The movable section may rotate continuously in the same direction, rather than oscillate. Any suitable drive mechanism may be used for imparting the desired motion to the movable section. Where plural movable sections are used, all of the movable sections may have the same type and direction of movement, or combinations of different movements may be used.

Figure 7:
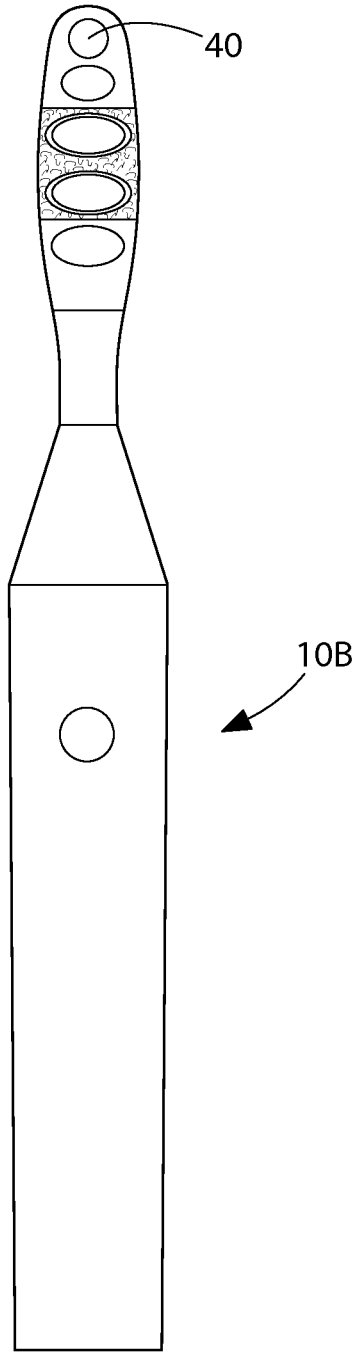
FIG. 7 is a front elevational view of a further toothbrush in accordance with this invention.

FIG. 7 illustrates a toothbrush 10B which includes a power driven movable disc or section 40 having cleaning elements. The movable section 40 could be oscillated rotationally such as by using the type of drive mechanism shown in U.S. Pat. No. 5,625,916, or could move in and out using the type of drive mechanism shown in U.S. Pat. No. Re. 35,941, all of the details of both patents are incorporated herein by reference thereto. Alternatively, the other types of drives referred to above could move section 40 in other manners and directions. Although FIG. 7 shows movable section 40 to be at the distal end of the head, the movable section(s) could be located at any desired location on the head.

Figure 8:
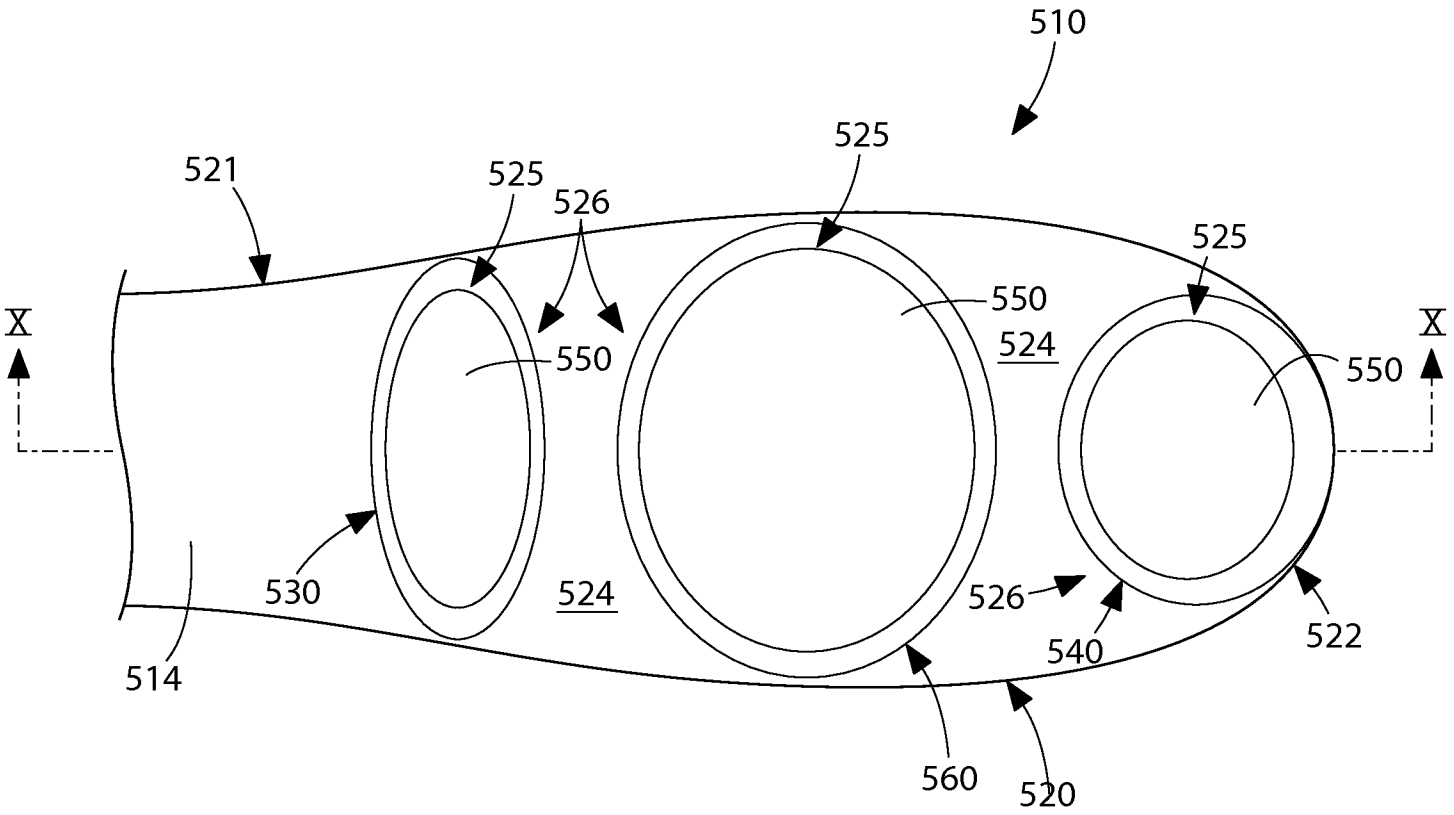
FIG. 8 is a top view of a portion of a toothbrush in accordance with an aspect of the present invention.

FIG. 8 illustrates a toothbrush 510 according to an aspect of the present invention. The toothbrush 510 includes an elongated handle (not shown) that may be formed of any shape and with a variety of constructions that permit the toothbrush 510 to be readily gripped and manipulated for effective tooth and gum cleaning. The toothbrush 510 also includes a neck 514 and a head 520 having a first end 521 proximate the neck 514 and a second, free end 22 distal the neck 514. The head 520 also includes a base 524 and spaced cleaning element support members 526. The base 524 provides an area onto which the cleaning element support members 526 are secured, in any known manner (See FIG. 9).

Figure 9:
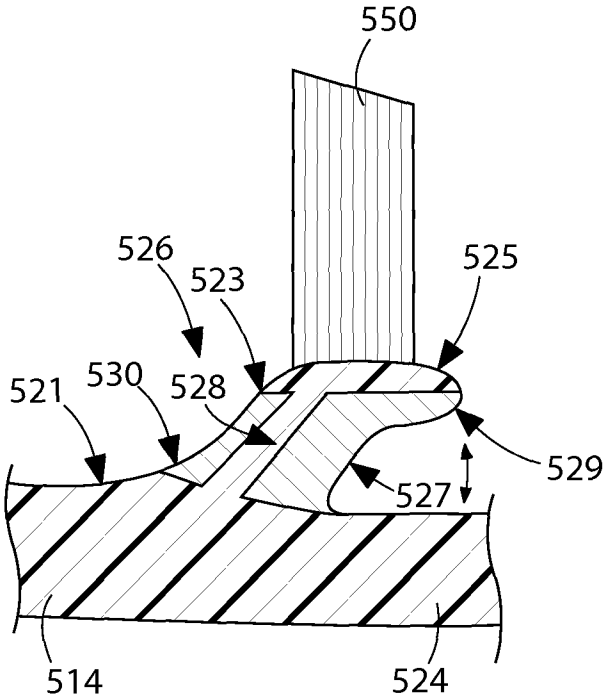
FIG. 9 is a cross section of an exemplary cleaning element support member according to an aspect of the present invention.

FIG. 9 illustrates an isolated example of a cleaning element support member 526 according to an aspect of the present invention. The exemplary cleaning element support member 526 includes a stem 527 and a flexion control member 528 positioned within the stem 527. The cleaning element support members 526 also include a support head 523 with a section 529 that overhangs the stem 527 in the direction of the center of the other cleaning element support members 526. The body of the stem 527 that surrounds each flexion control member 528 and each support head 523 are formed of flexible materials, such as flexible resins. In an embodiment, the flexible resins usable with the support members 526 include soft thermoplastic elastomers (TPE). Other soft, resilient materials can also be used to form the stems 527 and the support heads 523. The resilient material of the support members 526 serves to bias the stems 527 and flexion control members 528 back to initial, rest position after they have been deflected. This return action creates an active motion in the opposite direction of the initial flexion of the support members 527, which aids in the cleaning of teeth by introducing additional cleaning strokes and by strengthening the cleaning stroke because of the bias force created by the material.

The flexion control members 528 limit the flexibility of their respective support members 526. The internally extending flexion control members 528 can be of any shape that allows some flex and have a cross-section that is circular, square or any other geometric shape that provides a thin dimension or thin diameter about which the support member 526 can bend. The size of this thin dimension/diameter can contribute to the total amount of flex experienced by each cleaning element support member 526.

The flexion control members 528 are each secured to the base 524 or alternatively they are formed together with the base 524 as an integral unit. The flexion control members 528 can be formed of conventional hard plastic materials, such as polypropylene. In an alternative embodiment, the flexion control members 528 can be formed of a more flexible material that allows their respective stems 527 additional movement in a direction at an angle to its length during brushing. For example, each stem 527 would be capable of deflecting in a direction toward the center of the head 520 and, in embodiments, for example, with circular cross sections, deflect in all directions that extend at an angle to the longitudinal axis of the support member 526.

The cleaning element support members 526 also include carriers 525 that each supports at least one cleaning element 550. The cleaning elements can be used to clean the teeth, gums and/or tongue of a user. In the illustrated embodiment of FIG. 8, the cleaning elements 550 are in the form of bristles arranged in bristle tufts 552 that are secured to the carriers 525. However, one or more elastomeric members or other forms of cleaning members may be used to form the cleaning elements in lieu of or in addition to the use of bristles arranged in bristle tufts. The term "cleaning element" is intended to be used in a generic sense which could also include massage elements and other forms of cleaning elements such as elastomeric fingers or walls arranged in a circular cross-sectional shape or any type of desired shape and/or cross-section including straight portions or sinusoidal portions.

The carriers 525 are each supported by a flexion control member 528 and secured to the support head 523 of their respective stem 527, as illustrated in FIG. 9. The carriers 525 are preferably formed from conventional hard plastic materials, such as polypropylene, commonly used in the making of toothbrush handles and heads. However, other known hard materials can be also be used. The cleaning elements 550 extend from the carriers 525 for performing an oral care function within the mouth of the user. The tooth cleaning elements 550 can be anchored to their carrier 525 using any known technique. For example, the tooth cleaning elements 550 can be anchored into their carrier 525 during the formation of the carrier 525 (e.g., in mold tufting or anchor free tufting). Alternatively, the cleaning elements 550 can be anchored using other known techniques, such as, stapling, pinning or gluing.

While FIGS. 9-12 illustrate the cleaning elements 550 oriented generally perpendicular to the outer surface of base 524, some or all of the cleaning elements 550 may be oriented at various angles with respect to the outer surface of the base 524. It is thereby possible to select the combination of cleaning element configurations, materials and orientations to achieve specific intended results to deliver additional oral health benefits, like enhanced cleaning, tooth polishing, tooth whitening and/or massaging of the gums.

Figure 10:
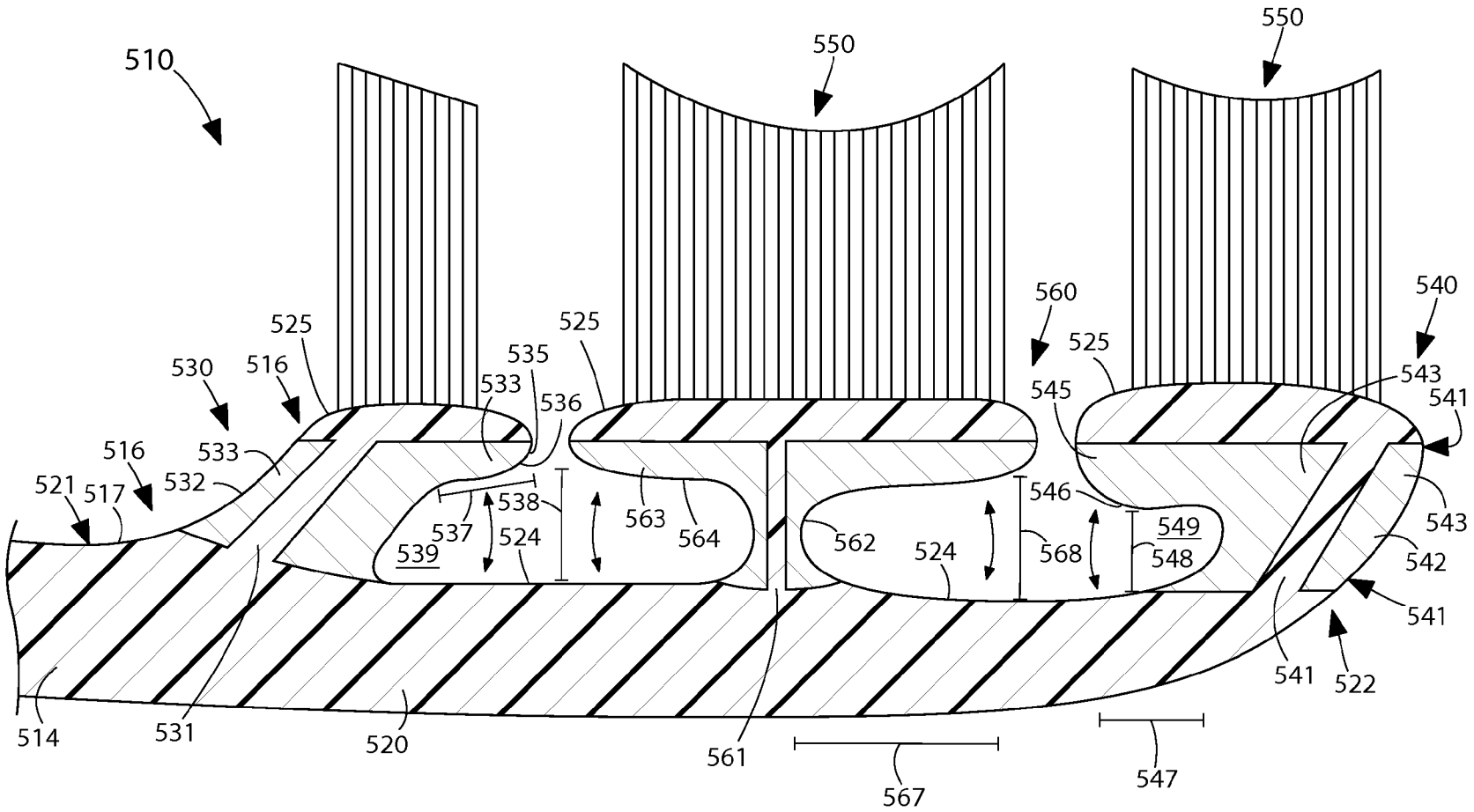
FIG. 10 is a cross section taken along line 3-3 of FIG. 8.
Figure 12:
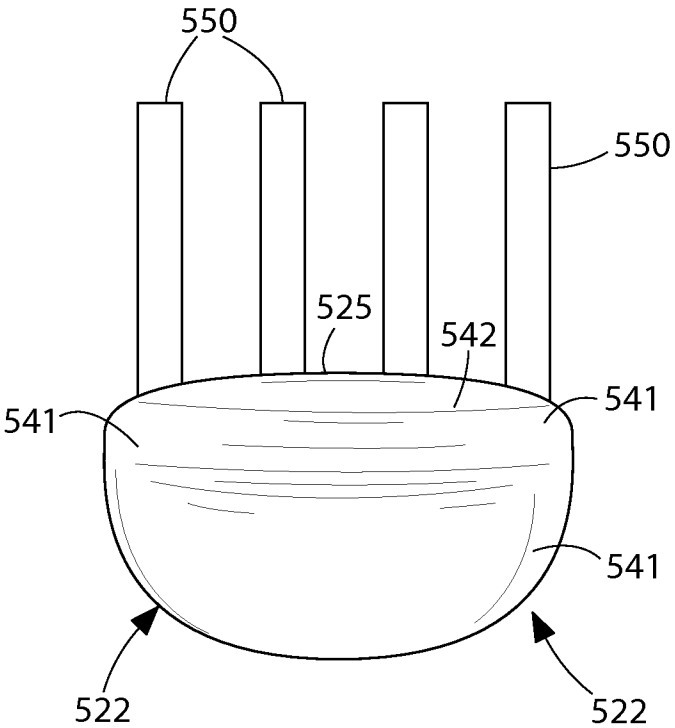
FIG. 12 is an elevational view of a portion of the toothbrush shown in FIG. 8 taken opposite the view of FIG. 11.
Figure 11:
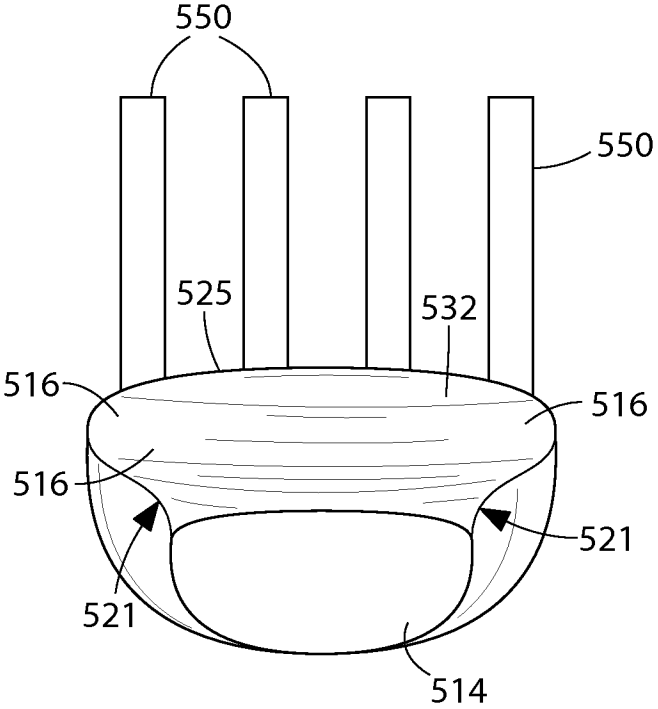
FIG. 11 is an end view of the portion of the toothbrush shown in FIG. 8.

As shown in FIGS. 8-10, the head 520 includes a plurality of the exemplary cleaning element support members 526. In the illustrated embodiment, the head 520 includes three spaced cleaning element support members 530, 540, 560 having the same components as support members 526. However, the head 520 can include only two or more than three support elements spaced along the head 520. The positioning of the support elements 526 along the head 520 is not limited to the linear arrangement illustrated in the figures. Instead, the support elements 526 can be arranged in any fashion on the head 520.

As illustrated in FIG. 10, the first support member 530 is positioned at the first end 521 of the head 520. The body of this support member 530 includes a stem 532 and a support head 533. The stem 532 forms a smooth, continuous surface 516 with a portion 517 of the head 520 proximate the neck 514. The continuous surface 516 formed between the head 520 and the stem 532 is sized and shaped so it will be easily received and manipulated within the mouth. The continuous surface 516 provides a profile having a shape that is similar to that of a comfortable, conventional toothbrush head. Additionally, the soft material used to form the stem 532 will deflect when it engages a portion of the user's mouth. As a result, the soft, flexible material of the stem 532 provides the user with additional comfort.

The support head 533 has a greater diameter/width than the stem 532 that extends away from it toward the neck 514. The portion 535 of the support head 533 that overhangs the stem 532 creates a partial mushroom-shaped profile. This portion 535 is also movable relative to the stem 532 and the base 524, as illustrated by the arrows in FIG. 10. The overhanging portion 535 has a lower surface 536 spaced from the base 524 by a distance 538. As shown, a channel 539 is formed between the lower surface 536 and the base 524. The distance 538 is greater than the distance 537 that the overhanging portion 535 extends beyond the stem 532 in the direction of the second end 522. The distance 538 allows the overhanging portion 535 to deflect toward the base 524.

The flexion control member 531 within the stem 532 limits the total deflection of the support member 530 and cooperates with the material of the stem to return the stem 532 and its carrier 525 to their original, rest position. This deflection and return movement of the stem 532 and its carrier 525 allow the cleaning elements 550 to follow the teeth during cleaning and create an enhanced cleaning action within the mouth of the user. In an alternative embodiment, the distance 538 could be shorter than the distance 537. In such an embodiment, the base 524 could limit the travel of the overhanging portion 535. Regardless of the distance 538, the support member 530 is capable of achieving 360 degrees of movement relative to its central longitudinal axis.

The second end 522 of the head 520 also includes the second cleaning element support member 540 that forms a continuous smooth surface 541 with the free end of the base 524 at the second end 522 of the toothbrush 510. The continuous surface 541 is sized and shaped so it will be easily received and manipulated within the mouth of the user. As shown, the second end 522 has a convexly curved profile that is similar to some comfortable, conventional toothbrush heads. This convex curve allows the end of the toothbrush 510 to be easily and comfortably received within the user's mouth during brushing. Additionally, the soft material used to form the stem 542 will deflect when it engages a portion of the user's mouth. As a result, the soft, flexible material of the stem 542 provides the user with additional comfort.

The body of this support member 540 includes the stem 542 that carries a support head 543 and a flexion control member 541. The support head 543 has a greater diameter/width than the stem 542 and forms a partial mushroom-like shape, as illustrated. The portion 545 of the support head 543 that overhangs the stem 542 is similar to overhanging portion 535. The overhanging portion 545 is movable relative to the base 524 and includes a lower surface 546 that is spaced from the base 524 by a distance 548. As shown, a channel 549 is formed between the lower surface 546 and the base 524. The distance 548 is less than a distance 547 that the overhanging portion 545 extends beyond the stem 542 in the direction of the first end 521. Alternatively, the distance 548 could be greater than the distance 547, as discussed above with respect to support member 530. The distance 548 allows the overhanging portion 545 to deflect toward the base 524 and provide the same cleaning benefits discussed above with respect to the first support element 530. Additionally, the support member 540 is capable of achieving 360 degrees of movement relative to it central longitudinal axis.

As shown in FIG. 10, the head 514 also includes at least one intermediate support member 560 positioned between the support members 530, 540. The total number of intermediate support members 560 can vary based on their size, the size of the base 524 and the distance between the support members 530, 540. As with the other support members 530, 540, the intermediate support member 560 includes a flexion control member 561, a flexible stem 562, and a flexible support head 563 that receives a carrier 525.

As shown in FIG. 10, the support member 560 has a substantially mushroom-like shape. A lower surface 564 of the support head 563 is spaced from the base 524 by a distance 568 that is less than its length 567 from the stem 562. Nevertheless, the distance 568 is sufficient to permit the flexible support head 563 to deflect in any direction toward the base 524. In an alternative embodiment, the length 567 can be less than the distance 568 so that the base 524 cooperates to control the total deflection of the stem 562. Due to its shape and materials, the intermediate support member 560 can deflect in any direction. The support head 563 is capable of flexing in the direction of the first end 521, the second end 522 and/or the sidewalls of the head 520. As a result, the resilient intermediate support member 560 is capable of moving in all directions to provide enhanced cleaning to the teeth of the user.

While only a few toothbrush variations are disclosed herein, the invention could be used in toothbrushes having many variations in, for example, the head, handle, and materials used. Additionally, the toothbrush could be a powered toothbrush. The head 520 can also be removably secured to the handle 512 whether it is powered or manual. Further, those skilled in the art will appreciate that there are numerous variations and permutations of the above described systems and techniques. It is to be understood that other embodiments may be utilized and structural and functional modifications may be made without departing from the scope of the present invention.

While the foregoing description and drawings represent the exemplary embodiments of the present invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

What is claimed is:

1. A toothbrush comprising:

a head comprising a base, a first flexible cleaning element support member extending from said base and comprising a first flexible stem and a first flexible support head having a portion overhanging a portion of said first flexible stem, a second flexible cleaning element support member spaced from said first flexible cleaning element support member along said base and comprising a second flexible stem and a second flexible support head having an outer peripheral edge, and a third flexible cleaning element support member positioned between said first and second flexible cleaning element support members;

wherein said third flexible cleaning element support member comprises a third flexible stem extending from said base; and wherein a first portion of said outer peripheral edge of said second flexible support head overhangs a portion of said second flexible stem and a second portion of said outer peripheral surface of said second flexible support head is free of an overhang relative to said second flexible stem.

2. The toothbrush of claim 1, wherein said first and second flexible support heads further comprise carriers from which at least one cleaning element extends.

3. The toothbrush of claim 1, wherein each flexible cleaning element support member further comprises a flexion control member.

4. The toothbrush of claim 3, wherein said flexible stems further comprise flexion control members.

5. The toothbrush of claim 3, wherein said flexion control members are capable of flexing relative to said base, and wherein each flexible stem is formed of a resilient material.

6. The toothbrush of claim 1, wherein each support head is spaced a distance from said base, said distance forming a gap between an undersurface of each support head and said base, and wherein each said support head is capable of deflecting into a respective one of the gaps in the direction of said base.

7. The toothbrush of claim 1, wherein said second portion of said outer peripheral surface of said second support head and said second flexible stem form a continuous surface with an outer surface of said base.

8. The toothbrush of claim 1, further comprising a neck and a handle, and wherein said base, said first flexible stem and a portion of said first flexible support head form a continuous surface along a portion of said toothbrush proximate said neck.

9. The toothbrush of claim 1, wherein said flexible stems are formed of a resilient material.

10. The toothbrush of claim 1, wherein said third flexible cleaning element support member comprises a third flexion control member positioned within said third flexible stem and a third flexible support head.

11. The toothbrush of claim 10, wherein said third flexible cleaning element support member further comprises a portion overhanging a portion of said third flexible stem on opposite sides of said third flexible stem.

12. The toothbrush of claim 1, wherein said third flexible cleaning element support member further comprises a carrier from which at least one cleaning element extends.

13. A toothbrush comprising:

a handle;

a head connected to said handle and extending along a longitudinal axis from a proximal end to a distal end, the head having:

a body portion;

a base member at a distal end of the head protruding outwardly from a front surface of the body portion, the base member being substantially non-movable relative to the body portion and comprising at least one outwardly extending tooth cleaning element;

a plurality of pods, each of the plurality of pods comprising at least one outwardly extending cleaning element, each of the plurality of pods movable relative to the body portion and resilient so that the at least one cleaning element of said plurality of pods is movable from an initial position and being returnable to said initial position;

a channel separating adjacent ones of the plurality of pods so that each of the plurality of pods can move independent of one another; and a second base member protruding outwardly from the front surface of the body portion, the second base member being substantially non-movable relative to the body portion and comprising at least one outwardly extending tooth cleaning element, the second base member and the base member located on the longitudinal axis.

14. The toothbrush of claim 13 wherein a first portion of the base member forms a smooth continuous surface with a portion of a peripheral surface of the body portion at the distal end of the head.

15. The toothbrush of claim 14 wherein the base member comprises an overhanging portion opposite the first portion.

16. The toothbrush of claim 13 wherein the base member is located on the longitudinal axis.

* * * * *